United States Patent [19]

Olson et al.

[11] Patent Number: 4,462,555

[45] Date of Patent: Jul. 31, 1984

[54] SPLIT REEL WITH QUICK-RELEASE FLANGE

[75] Inventors: John G. Olson, Westmont; Joseph C. Kmiecik, Orland Park, both of Ill.

[73] Assignee: AT&T Technologies, Inc., New York, N.Y.

[21] Appl. No.: 449,290

[22] Filed: Dec. 13, 1982

[51] Int. Cl.[3] ..... B65H 75/14

[52] U.S. Cl. ..... 242/118.6

[58] Field of Search ..... 242/118.4, 118.6, 118.61, 242/71.8, 71.9; 403/349; 57/1 R, 59, 218

[56] References Cited

U.S. PATENT DOCUMENTS

| | | | |
|---|---|---|---|
| 2,494,612 | 1/1950 | Goldberg et al. | 242/71.8 |
| 2,563,198 | 8/1951 | Thalhammer | 242/71.8 |
| 2,846,160 | 8/1958 | Thomason | 242/71.8 |
| 3,013,378 | 12/1961 | Newton, Jr. | 57/1 R |
| 3,836,093 | 9/1974 | Mozina et al. | 242/118.6 |

*Primary Examiner*—Leonard D. Christian
*Attorney, Agent, or Firm*—K. R. Bergum

[57] ABSTRACT

A split reel (10), particularly adapted for temporarily storing a wound supply of elongated material, such as scrap wire, includes a cylindrical hub (12) having a first flange (14) fixedly secured to one end, and a second flange (16) releasably secured to the other end thereof. The releasable flange (16) is uniquely secured to the hub through the use of two identical quick-release locking mechanisms (21, 22) which are preferably mutually disposed relative to the axis of the reel (10). With reference to only representative locking mechanism (21), it includes two cooperatively engaging portions, one portion including a releasable flange-mounted cylindrical member (23) that is positioned and dimensioned to be telescopically received within a second portion, comprising a hub-mounted cylindrical member (24). The hub-mounted cylindrical member (24) is preferably formed with a pair of circumferentially spaced detent-receiving slots (33, 34) that communicate with an interior detent-receiving locking notch (38*a* or *b*). The flange-mounted cylindrical member (23) retractably and rotatably supports therewithin a spring-biased plunger (31) having an inner end preferably including two outwardly projecting locking detents (31*d* and *e*). The detents are circumferentially spaced so as to be respectively received within different ones of the slots, and ultimately, when the reel is assembled, within the associated locking notches formed in the hub-mounted cylindrical member. In an optional split reel embodiment, a plurality of rod-like members (46*a–d*) the cylindrical hub (12) into an effectively tapered hub.

11 Claims, 7 Drawing Figures

SPLIT REEL WITH QUICK-RELEASE FLANGE

FIELD OF THE INVENTION

This invention relates to supply reels and, more particularly, to those of the split reel type having a removable quick-release flange.

BACKGROUND OF THE INVENTION

In many reel storage applications, it is very desirous to use a so-called split reel wherein at least one flange thereof may be quickly released from the hub so as to allow a wound supply of elongated material, such as in the form of scrap wire, to be readily removed en masse from the hub for reprocessing.

In one prior reel employed for that purpose heretofore, the hub is formed of complementary sections made out of rather expensive case bronze, with the hub being split along a transversely-oriented zig/zag center line. A portion of one of the split hub sections is further formed with threads along an inner bore-defining wall area thereof, with such threaded portion being adapted to engage a complementary threaded portion of an inner core fixedly secured to the other split hub and flange section. Such a split reel is not only rather expensive to construct, but also does not provide for the quick release of one hub section and flange from the other one, as is often desired in many industrial applications. In addition, a special tool is required in order to rotate and, thereby, threadably engage (or disengage) the two split hub sections.

W. A. Newton, Jr., U.S. Pat. No. 3,013,378 discloses a flanged bobbin adapted for handling yarn wherein one flange is releasably secured to the adjacent end of the bobbin core or hub through the use of either a threaded hub-flange interconnection, or a hub-secured bayonet and flange-formed cam groove type interconnection. With respect to both of the aforementioned types of hub flange interconnections, they normally are not applicable for high speed bi-directional reel rotation, because of the danger of the releasable flange becoming unthreaded (or bayonet-released) from the hub, unless both the hub and flange are in some way keyed to the reel support shaft. In many industrial applications, however, it is desirous to utilize circular reel support shafts with no keying provisions so as to allow the quick changing of reels supported thereon. In addition, in large reel industrial wire winding applications, it is also normally desirous to form the reel hubs and flanges of sheet stock material as thin as possible (without compromising necessary structural rigidity) so as to minimize the weight of the reel. This often makes it impossible to provide reliable hub-flange interconnections of either the threaded or bayonet-cam groove engaging types.

There has been a further need for a split reel having a specially configured hub that would not only facilitate the removal of a wound supply of relatively heavy material, such as scrap wire, en masse therefrom, but at the same time produce a non-uniform winding pattern that would allow an operator to easily visually differentiate between otherwise indistinguishable reels of scrap versus good wire, for example.

H. F. Mozina et al. U.S. Pat. No. 3,836,093 discloses a wire holding barrel constructed of two flanges that permanently support four longitudinally extending and circumferentially disposed arcuate staves, with each of the latter preferably having a continually increasing radius along the length thereof. As such, the staves define a barrel hub with an effective circumference that varies from a maximum adjacent one flange to a minimum adjacent the other flange. The described purpose of such staves is to prevent a problem referred to as "dishing" of the flanges when the reel is wound with a supply of wire. However, as the staves are necessarily fixedly secured to both flanges, there is no way that such staves may also be used to readily remove a wound supply of scrap wire en masse therefrom.

SUMMARY OF THE INVENTION

In accordance with the principle of the present invention, one preferred illustrative split reel, particularly adapted for temporarily storing scrap wire, is comprised of a cylindrical hub having a first flange fixedly secured to one end, and a second flange releasably secured to the other end thereof. The releasable flange is uniquely connected to the hub through the use of two quick-release locking mechanisms that are preferably diameterically disposed relative to the axis of the reel.

More specifically, each locking mechanism includes two cooperatively engaging portions, one portion including a releasable flange-mounted cylindrical member that is positioned and dimensioned to be telescopically received within a second portion, comprising a hub-mounted cylindrical member. The latter is preferably formed with a pair of circumferentially spaced detent-receiving slots, each having a longitudinally disposed section, with an outer open end, and an inner end that merges into a circumferentially disposed slot section which, in turn, communicates with an interior detent-receiving and locking notch. The flange-mounted cylindrical member of each locking mechanism retractably and rotatably supports therewithin a spring-biased plunger having an outer end, with a kerf, and an inner end preferably including two outwardly projecting locking detents. The detents are circumferentially spaced so as to be respectively received within different ones of the slots and, ultimately, associated locking notches formed in the hub-mounted cylindrical member.

As thus constructed, and when assembled, the releasable flange is readily separated from the hub of the reel by simply inserting the end of a screwdriver in the kerf of each locking mechanism plunger, in succession, and exerting sufficient manual force thereagainst to effect the release of the two associated locking detents from within the respective notches of the associated hub-secured cylindrical member. Thereafter, each locking mechanism plunger is rotated in the proper direction (i.e., counterclockwise) so as to initially force the detents thereof along the respective circumferential slot sections until they are received within the respective longitudinal slot sections of the associated hub-secured cylinder. With the detents thus positioned, the releasable reel flange may then be grasped and easily separated from the previously interlocked end of the hub. This, of course, then allows any wound supply of material on the hub, such as scrap wire, to be readily removed en masse therefrom.

As an optional modification, the split reel embodied herein may be further provided with a plurality of fixedly secured rod-like members that are circumferentially disposed about, and extend along, the hub at an oblique angle relative thereto. This transforms the normally cylindrical hub into an effectively tapered hub.

Such a modified reel hub can significantly facilitate the removal of a supply of tightly wound scrap wire, for example, en masse therefrom. It also results in a wound supply of wire (or any other strand-like material) having a nonuniform (or asymetrical) winding pattern. This can advantageously allow an operator, for example, to visually differentiate between otherwise indistinguishable reels of scrap versus good wire.

DETAILED DESCRIPTION OF THE DRAWINGS

FIG. 1 is an enlarged perspective view, partially in section, of one preferred illustrative embodiment of a split reel incorporating a quick-release flange and, in particular, illustrates schematically the positional relationship of a pair of uniquely constructed locking mechanisms for releasably securing the removable flange to the adjacent end of the reel hub, in accordance with the principles of the present invention;

FIG. 2 is an enlarged, fragmentary detail perspective view, partially broken away, of one of the two releasable flange-locking mechanisms embodied in the split reel of FIG. 1;

FIG. 3 is an exploded side elevational view of the split reel of FIG. 1, with certain structural details of the hub and flange-mounted portions of the locking mechanisms being shown only in phantom, and further illustrates the use of optional rod-like members, also shown only in phantom, positioned in spatial relationship about, and extending along and at an oblique angle relative to, the cylindrical hub so as to transform the latter into an effectively tapered hub, in accordance with a modified embodiment of the present invention.

Figure 1:
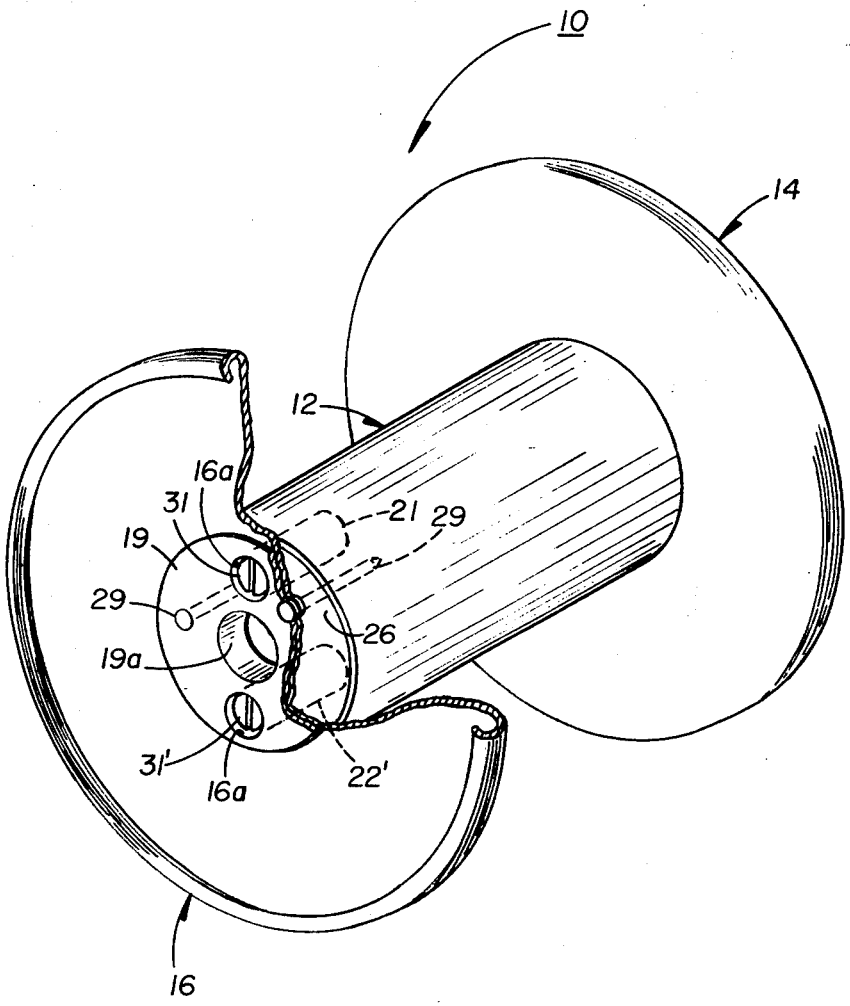
Figure 3:
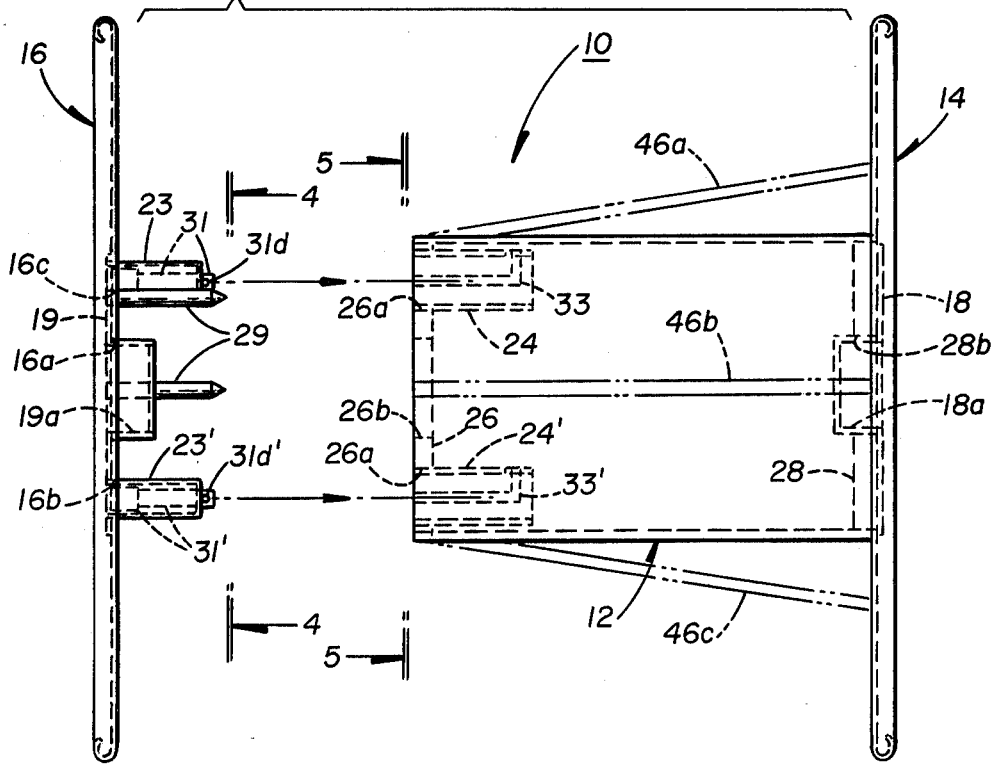
Figure 6:
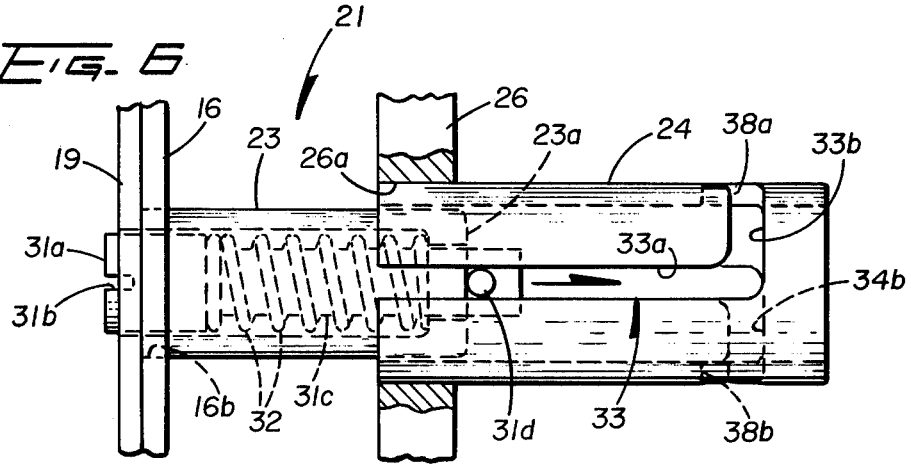
Figure 7:
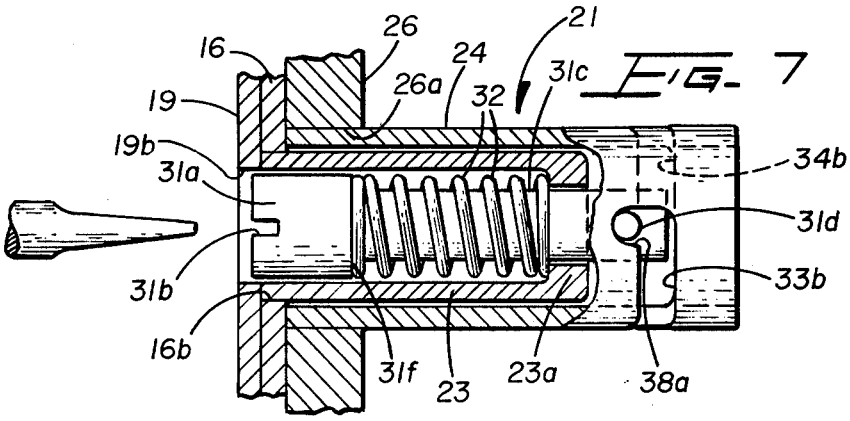

FIG. 6 is an enlarged, fragmentary detail side elevational view, partially in section and in phantom, of one of the two locking mechanisms incorporated in the split reels of FIGS. 1 and 3 and, in particular, illustrates the positional relationship between the releasable flange-mounted portion and the hub-mounted portion of one locking mechanism before the former is telescopically received within and releasably interlocked with the latter, and FIG. 7 is an enlarged, fragmentary detail view, mainly in cross-section, of the two portions of the locking mechanism of FIG. 6 after having been brought into concentric and interlocked relationship.

DETAILED DESCRIPTION OF THE INVENTION

It should be appreciated that while the invention is described in detail herein primarily in regard to the temporary storing and en masse removal of reel-wound scrap wire, the illustrative split reels embodied herein are equally applicable, in varying sizes, and when made of various types of materials, for use in winding, storing, en masse removing or paying-off diverse types of elongated material in various industrial applications.

Figure 2:
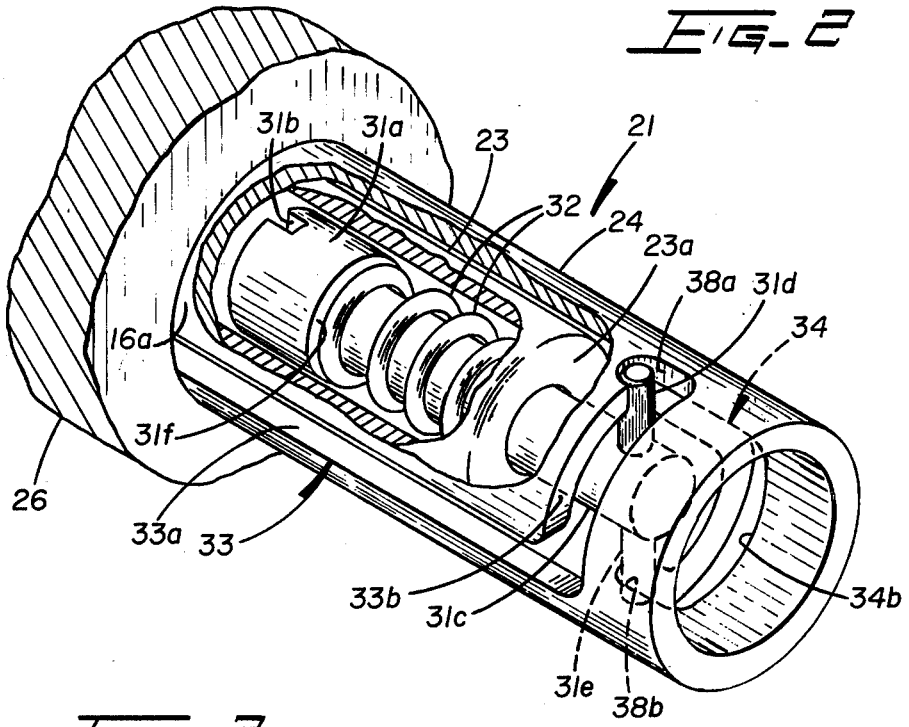

With particular reference first to FIGS. 1–3, there is illustrated one preferred embodiment of a split reel 10 comprised of a cylindrical hub 12 having a first flange 14 fixedly secured to one end, and a second flange 16 removably secured to the other end, thereof. Each of the flanges 14, 16 has an axial bore **14*a* or 16*a*, and preferably includes a circular support plate 18 (seen only in FIG. 3) or 19 suitably secured to the outer surface thereof, such as by threaded fasteners (not shown). Each of the support plates is formed with an axially disposed cylindrical bearing portion 18*a* or 19*a*, adapted to be received within an associated end of the hub 12**.

In accordance with an aspect of the present invention, the flange 16 is removably connected to the hub 12 through the use of two diametrically disposed and uniquely constructed locking mechanisms 21 and 22. As these mechanisms are identical in construction, a detailed description will be given with reference to only the upper one, namely, 21, as viewed in FIG. 1. To that end, it should be understood that the corresponding parts of locking mechanism 22 are herein identified by like, but primed, reference numerals.

With particular reference now to FIGS. 2, 6 and 7, the locking mechanism 21, as assembled, includes a pair of interlocked and concentric cylindrical members 23 and 24. The inner cylindrical member 23 is fixedly secured at one end, such as by weldments, within a bore **16*b* formed in the releasable flange 16, and is oriented to extend perpendicularly outward therefrom. The outer cylindrical member 24 is fixedly secured at one end, such as by weldments, to a circular end plate 26 and, in particular, within a bore 26*a* thereof. The end plate 26 is preferably also secured by weldments within, and encloses, the end of the hub 12 nearest the removable flange 16. As also seen only in FIG. 3, the circular end plate 26, as well as a similar end plate 28, positioned at the opposite end of the hub 12, are respectively formed with axially disposed bores 26*b* and 28*b* which accommodate the bearing portions 19*a* and 18*a* of the aforementioned and respectively associated flange support plates 19 and 18**.

With reference again to the outer cylindrical member 24, it is positioned and oriented so as to telescopically receive the flange-secured cylindrical member 23 concentrically therewithin. A pair of the pilot pins 29 (seen only in FIGS. 1, 3 and 4), are employed not only to facilitate the telescopic and, ultimately, concentric positioning of the cylindrical members 23 and 24, but the rotational locking of the releasable flange 16 to the hub 12. To that end, the pins 29 are secured within bores **16*c* (see FIG. 4) of, and extend perpendicularly outward from, the releasable flange 16 so as to be received within respectively aligned and close-fitting bores 26*c* formed in the circular support plate 26 (see FIG. 5**).

The inner cylindrical member 23 of the locking mechanism 21, as best seen in FIGS. 2, 6 and 7, retractably supports a spring-biased plunger 31. The latter has an outer head portion **31*a*, with a kerf 31*b* formed in the outer end thereof, and an inner shank portion 31*c* which is formed with, or otherwise supports, two preferably diametrically disposed and radially projecting stub-like locking detents 31*d* and *e* (also seen in FIG. 4). As will be described in greater detail hereinafter, a coil spring 32 is coaxially mounted on the shank portion 31*c* of the plunger, and is normally maintained under compression between an inner plunger shoulder 31*f* and an inwardly directed, end wall-defining shoulder or cap 23*a* formed as an integral part of the cylindrical member 23**.

The larger diameter hub-secured cylindrical member 24 is formed with a pair of multi-sectioned detent-receiving slots 33 and 34. Each of the latter slots includes a longitudinally disposed section **33*a* or 34*a* that extends from the outermost end of the cylindrical member 24, as best seen in FIGS. 2 and 6, to a point rearward of the innermost end thereof, whereat it merges into an associated circumferentially disposed slot section 33***b* or 34*b*. The two longitudinal slot sections 33*a* and *b*, as illustrated, are preferably diametrically disposed so as to accommodate the respective and similarly disposed plunger locking detents 31*d* and *e*.

Each of the circumferential slot sections 33*b* or 34*b* terminates at, and merges into, a short longitudinally disposed detent-receiving and locking notch 38*a* or *b* (best seen in FIGS. 2 and 7). It is understood, of course, that any other desired number of compound slots 33 and 34, and associated detent-locking notches 38, could be formed in the wall of the outer cylindrical member 24 so as to accommodate any desired corresponding number of plunger-mounted locking detents 31.

With reference again to the plunger biasing coil spring 32 in representative locking mechanisms 21, it is employed, as best seen in FIGS. 2 and 7, to insure that the locking detents 31*d* and *e* of the plunger 31 remain reliably, but releasably, nested within the respectively associated locking notches 38*a* and *b* of the cylindrical member 24. This is accomplished by the coil spring 32 continuously biasing the plunger 31 in a direction toward the releasable flange 16, as assembled.

While only two diametrically disposed releasable locking mechanisms 21, 22 are employed in the illustrative split reel 10, it is apparent that a larger number of such mechanisms may be used, if desired, for a given industrial application. Generally, the actual number of locking devices required would increase in direct relation to an increase in reel hub diameter. For the particular application of primary concern herein, however, wherein the split reel has a hub diameter of approximately 8.5 inches, and is adapted to temporarily store a wound supply of scrap wire typically weighing on the order of 16–20 pounds, it has been found that the two diametrically disposed locking mechanisms 21, 22 have proven very adequate in reliably securing the flange 16 to the reel hub 12.

For that application, and by way of further example only, the hub 12, flanges 14, 16 and circular plates 26 and 28, as well as the cylindrical members and plungers of the locking mechanisms 21, 22, are all made out of low carbon steel. It is also understood, of course, that for the same, as well as for many other material winding and storing applications, lighter materials, such as aluminum, or in many cases suitable plastic materials, could be used to form all or selective parts of the composite split reel 10 embodied herein with equal effectiveness.

With the split reel constructed as described in detail hereinabove, it is seen that the releasable flange 16 thereof may be readily separated from the hub 12 by first preferably resting the reel on the fixedy secured flange 14. As thus positioned, the spring-biased plungers 31, 31' of the locking mechanisms 21, 22 are fully exposed through respective bores 19*b* formed in the circular support plate 19 and respectively aligned bores 16*b* formed in the releasable flange 16, as best seen in FIGS. 6 and 7. A screwdriver may then be employed to axially displace each spring-biased plunger 31, 31', in succession, and sufficiently, to effect the release of the two associated locking detents 31*d, e* (or 31*d', e'*) from within the respective locking notches 38*a* and *b* (or 38*a'*and *b'*) of the hub-secured cylindrical member 24 (or 24').

Thereafter, and with reference to only the locking mechanism 21, a predetermined amount of rotation of the plunger 32, counterclockwise, forces the two detents 31*d* and *e* thereof along the respective circumferentially disposed slot sections 33*b* and 34*b* until they are received within the respective longitudinally disposed slot sections 33*a* and 34*a*. With the detents 31*d, e* and 31*d', e'* of the two locking mechanisms 21, 22 thus positioned, the releasable flange 16 may then be manually grasped and lifted upwardly so as to completely separate the latter from the previously engaging end of the hub 12.

At that time, the partially disassembled split reel 10 may be flipped over so that any previously wound supply of elongated material on the hub 12, such as in the form of scrap wire (not shown), may be readily removed from the then open end thereof. Gravity-induced displacement alone is normally sufficient for that purpose.

From the foregoing, it is seen that the locking mechanisms 21, 22 are not only of relatively inexpensive, simplified and reliable construction, but are also easily releasably locked, as well as unlocked. Equally important is the fact that the present locking mechanisms are in no way adversely affected by either the speed or direction of reel rotation.

Figure 5:
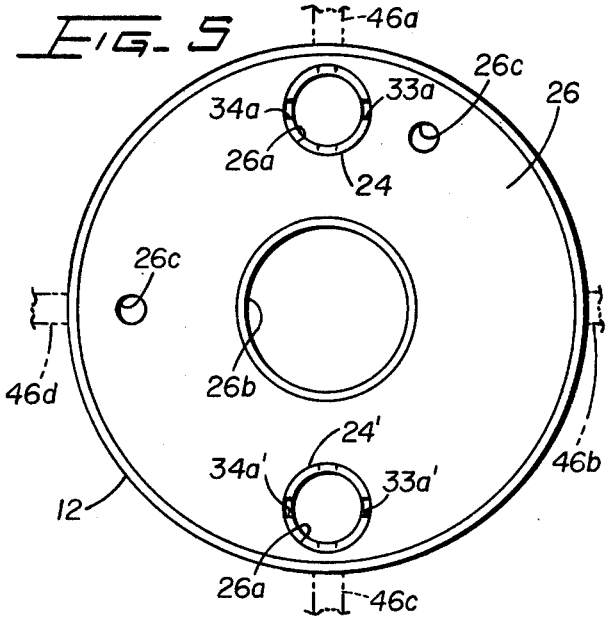
FIG. 5 is an enlarged end view of the hub of the split reel, with the optional spatially disposed rod-like members, taken along the line 5—5 of FIG. 3.

In order to further facilitate the rapid removal of wound supply of elongated material from the hub 12, the reel 10 may be optionally modified, as illustrated in phantom line form in FIGS. 3 and 5, to additionally include a plurality of rod-like members 46*a–d* that are spatially disposed about the hub 12. More specifically, the rods, which may be in the form of metal pipes, are dimensioned and positioned so as to each extend along, and at an oblique angle relative to, the hub 12. Such positioning is accomplished by securing the four illustrative rods 46*a–d* at one of their common ends to the inner side of the fixedly secured flange 14 at four separate radially and circumferentially spaced points thereabout. The opposite common ends of the rods are secured at four separate circumferentially spaced points to the hub at the releasable flange end thereof. Such rod securements are preferably accomplished through weldments.

The rods 46*a–d* are thus seen to transform the normally cylindrical hub 12 into an effectively tapered hub, wherein the modified hub diameter (or circumference) progressively decreases from a predetermined maximum adjacent the fixedly secured flange 14 to a minimum adjacent the releasable flange 16. With the split reel hub 12 thus modified, even a tightly wound supply of elongated wound material, such as in the form of scrap wire, may be readily removed therefrom. The effective taper of the modified hub also results in the wound supply of wire having a non-uniform or tapered profile. This can readily allow an operator, as previously noted, to visually differentiate between otherwise indistinguishable reels of scrap versus good wire.

Figure 4:
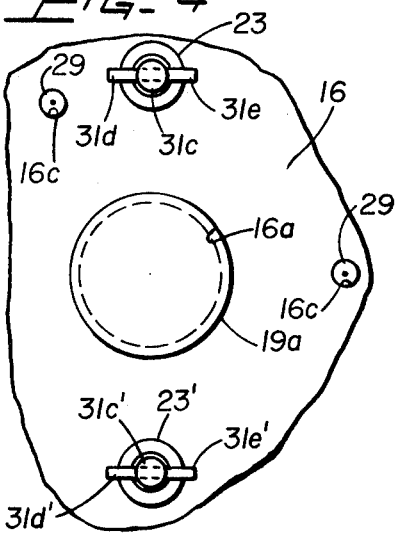
FIG. 4 is an enlarged end view of the releasable flange of the split reel, as illustrated in both FIGS. 1 and 3, taken along the line 4—4 of FIG. 3.

While four rods 46*a–d* have been shown arranged in space quadrature in the illustrative embodiment, as best seen in FIG. 4, it is understood that a lesser or larger number of such rods could be readily employed for the purpose intended with equal effectiveness. Generally, the number of rods employed would increase in direct relation to an increase in reel hub diameter.

While one a preferred split reel embodiment, which optionally embraces a modified hub, has been disclosed herein for one particular use in temporarily storing and, thereafter, easily removing an elongated supply of wound material, such as scrap wire, en masse from the hub thereof, it is obvious that various modifications may be made to the present illustrative claimed embodiments of the invention, and that a number of alternative related embodiments could be devised by one skilled in the art without departing from the spirit and scope of the invention.

What is claimed is:

1. A split reel comprising:

a tubular hub;

a first flange fixedly secured to a first end of said hub;

a second flange adapted to be releasably secured to a releasable locking means for releasably securing said second flange to the second end of said hub, said locking means including first and second cooperative portions adapted to be brought into adjacent and releasable locking engagement, said first portion comprising a first member having an arcuate wall area and being supported within the second end of said tubular hub, said arcuate wall area being formed with at least one detent-receiving slot having an outer open end, and an inner end region that communicates with a detent-receiving locking notch, said second portion of said locking means including a second member having an arcuate wall area and being secured to, and extending perpendicularly outward from the inner side of, said second flange so as to allow the adjacent positioning of said first and second members of said locking means, said second portion of the latter further including both engaging means retractably and rotatably supported by said second member, and biasing means also supported by said second member for urging said engaging means in a direction toward said second flange, said engaging means including at least one outwardly projecting locking detent adapted to be initially received within the open end of the slot of said first member and ultimately, under bias by said biasing means, within said communicating locking notch so as to effect the releasable locking engagement of said second flange to the second end of said tubular hub.

2. A split reel in accordance with claim 1 wherein said locking means first member is of cylindrical configuration, and wherein said second member is also of cylindrical configuration, and adapted to support and confine said biased engaging means including an elongated plunger, therewithin, said first cylindrical member also being positioned and dimensioned to telescopically receive said second cylindrical member therewithin and, thereby, allow said plunger locking detent to be seated, under bias, within said first member locking notch.

3. A split reel in accordance with claim 2 wherein there are at least two locking means disposed on opposite sides of the common axis passing through said hub and said second flange, as assembled.

4. A split reel in accordance with claim 3 wherein said first cylindrical member of each locking means includes at least two circumferentially disposed slots and respectively associated locking notches, and wherein said plunger of each locking means includes at least two outwardly projecting locking detents positioned so as to be respectively received within different ones of said first cylindrical member slots, and the associated one of said locking notches, in succession.

5. A split reel in accordance with claim 4 wherein a plurality of rod-like members are circumferentially disposed about and extend along said tubular hub at a predetermined oblique angle relative to the axis thereof, said rod-like members being secured at one of their common ends to the inner side of said first flange at separate circumferentially and radially spaced points thereabout, and being secured at the other of their common ends to said hub at separate circumferentially spaced points thereabout and in the region of said second end thereof, said rod-like members thus effectively transforming said tubular hub into a tapered hub, upon which elongated material may be wound, and having an effective diameter that progressively varies from a predetermined maximum adjacent said first flange to a minimum adjacent the second end of said hub.

6. A split reel adapted to facilitate the removal of a wound supply of elongated material en masse therefrom, comprising:

a cylindrical hub;

a first flange fixedy secured to a first end of said hub;

a circular end plate secured within a second end of said hub and formed with two diametrically disposed bores;

a pair of first cylindrical members each secured within a different one of said bores in said circular end plate, and extending inwardly of said hub toward said first end thereof, each of said first cylindrical members having at least one elongated detent-receiving slot formed therein, each slot including a first section that extends longitudinally from an outer end to a region inward of the inner end of the associated first cylinder, and a second section therein which extends a short distance circumferentially, with the terminating end thereof merging into a locking notch, said notch being oriented longitudinally, and extending a short distance toward the outer end, of said associated first cylindrical member;

a second flange;

a pair of second cylindrical members secured to said second flange and respectively positioned thereon so as to be telescopically received within different ones of said pair of first cylindrical members;

separate plunger means retractably mounted in each of said second cylindrical members, each plunger means including at least one outwardly projecting locking detent adapted to be initially received within the open end of the first slot section of said associated first cylindrical member and, ultimately, releasably seated within the locking notch of the associated cylindrical member, and biasing means mounted within each of said second cylindrical members for urging the associated plunger therein toward the second end of said hub, said biasing means thereby facilitating the seating of the associated locking detent, under spring bias, within the locking notch of said associated first cylindrical member so as to effect the releasable locking of said second flange to the second end of said hub.

7. A split reel in accordance with claim 6 wherein each of the pair of first cylindrical members includes at least two slots, and respectively associated locking notches, with the corresponding first longitudinal slot sections and locking notches in each first member being diametrically disposed, and wherein each of said plunger means includes an elongated plunger with two outwardly projecting locking detents that are diametrically disposed so as to be respectively received within different ones of the slots and locking notches of the associated first cylindrical member, in succession.

8. A split reel in accordance with claim 6 wherein each of said plunger means includes an elongated plunger with a headed portion and a shank portion, and wherein said biasing means comprises a coil spring coaxially mounted on said plunger shank portion and maintained in a compressive state, in the assembled split reel, between an inner shoulder defined at the interface between said headed and shank portions of said associated plunger and at least a partially enclosing innermost end wall of the associated second cylindrical member.

9. A split reel in accordance with claim 6 wherein a plurality of rod-like members are circumferentially disposed about and extend along said cylindrical hub at a predetermined oblique angle relative to the axis thereof, asid rod-like members being secured at one of their common ends to the inner side of said first flange at separate circumferentially and radially spaced points thereabout, and being secured at the other of their common ends to said hub at separate circumferentially spaced points thereabout and at said second end thereof, said rod-like members thus effectively transforming said cylindrical hub into a tapered hub, upon which elongated material may be wound, and having an effective diameter that progressively varies from a predetermined maximum adjacent said first flange to a minimum adjacent the second end of said hub, said inclined rod-like members thus facilitating the removal of a wound supply of elongated material en masse therefrom upon the removal of said second flange from said hub.

10. A split reel in accordance with claim 8 wherein each of the pair of first cylindrical members includes at least two slots, and respectively associated locking notches, with the corresponding first longitudinal slot sections and locking notches in each first member being diametrically disposed, wherein each of said plunger means includes an elongated member with two outwardly projecting locking detents that are diametrically disposed so as to be respectively received within different ones of the slots and locking notches of the associated first cylindrical member, in succession, and wherein said second flange includes at least one pilot pin projecting perpendicularly outward from the inner surface thereof, in the assembled reel, with said circular end plate including at least one aperture for receiving said pilot pin in close-fitting relationship therewith.

11. A split reel in accordance with claim 10 wherein a plurality of rod-like members are circumferentially disposed about and extend along said cylindrical hub at a predetermined oblique angle relative to the axis thereof, said rod-like members being secured at one of their common ends to the inner side of said first flange at separate circumferentially and radially spaced points thereabout, and secured at the other of their common ends to said hub at separate circumferentially spaced points thereabout and at said second end thereof, said rod-like members thus effectively transforming said cylindrical hub into a tapered hub, upon which elongated material may be wound, and having an effective diameter that progressively varies from a predetermined maximum adjacent said first flange to a minimum adjacent the second end of said hub, said inclined rod-like members thus facilitating the removal of a wound supply of elongated material en masse therefrom upon the removal of said second flange from said hub.

* * * * *